US009395143B2

(12) United States Patent
Barnett

(10) Patent No.: US 9,395,143 B2
(45) Date of Patent: Jul. 19, 2016

(54) CROSSBOW ARROW RETAINER

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 14/986,076

(22) Filed: Dec. 31, 2015

(65) Prior Publication Data

US 2016/0178310 A1 Jun. 23, 2016

Related U.S. Application Data

(63) Continuation of application No. 14/581,828, filed on Dec. 23, 2014, now Pat. No. 9,255,755.

(51) Int. Cl.
*F41B 5/12* (2006.01)
*F41B 5/14* (2006.01)
*F41B 5/22* (2006.01)

(52) U.S. Cl.
CPC . *F41B 5/143* (2013.01); *F41B 5/12* (2013.01); *F41B 5/123* (2013.01); *F41B 5/14* (2013.01)

(58) Field of Classification Search
CPC ..... F41B 5/12; F41B 5/143; F41B 5/14
USPC ..... 124/25, 44.5, 86
See application file for complete search history.

(56) References Cited

U.S. PATENT DOCUMENTS 3,225,755 A * 12/1965 Shankland ..... F41B 5/143 124/24.1
3,285,237 A * 11/1966 Wolfe ..... F41B 5/143 124/44.5
5,462,041 A * 10/1995 Solecki ..... F41B 5/143 124/24.1
5,598,829 A * 2/1997 Bednar ..... F41A 17/28 124/25
5,884,614 A * 3/1999 Darlington ..... F41B 5/1469 124/25
5,896,849 A * 4/1999 Branthwaite ..... F41B 5/143 124/44.5
RE38,096 E 4/2003 Branthwaite
6,561,175 B1 * 5/2003 Tidmore ..... F41B 5/143 124/44.5
6,725,851 B1 * 4/2004 Graf ..... F41B 5/143 124/44.5
6,736,123 B1 * 5/2004 Summers ..... F41A 17/46 124/25
6,789,535 B1 * 9/2004 McIntyre ..... F41B 5/143 124/44.5
6,994,080 B1 * 2/2006 Yoder ..... F41B 5/143 124/44.5
7,455,059 B2 * 11/2008 Shaffer ..... F41B 5/123 124/25
7,588,022 B2 * 9/2009 Chang ..... F41B 5/123 124/25

(Continued)

OTHER PUBLICATIONS

Design U.S. Appl. No. 29/532,935, "Crossbow Stock," Inventor: David A. Barnett, Applicant: Barnett Outdoors, LLC, filed Jul. 13, 2015 (co-pending application).

(Continued)

*Primary Examiner* — Alexander Niconovich
(74) *Attorney, Agent, or Firm* — Jones Walker LLP

(57) ABSTRACT

An arrow retainer for a crossbow including a projection extending from a hood of the crossbow to retain an arrow on a stock of the crossbow. A plurality of projections may be affixed to a retainer insert that is detachably disposed within a receptacle in the hood of the crossbow. Alternatively, the retainer insert may be detachably disposed within a recess of a housing that is detachably connected to the hood of the crossbow. A spring may bias the projection toward the stock. The projection may be formed of bristles or of a circumferential surface of a wheel member.

24 Claims, 17 Drawing Sheets

(56) References Cited

U.S. PATENT DOCUMENTS

| | | | | |
|---|---|---|---|---|
| 7,814,894 | B2 * | 10/2010 | Giroux | F41B 5/12 124/25 |
| 8,061,339 | B2 * | 11/2011 | Shaffer | F41B 5/123 124/25 |
| 8,091,540 | B2 * | 1/2012 | Matasic | F41B 5/12 124/25 |
| 8,342,161 | B2 * | 1/2013 | Harwath | F41B 5/143 124/41.1 |
| 8,522,761 | B1 * | 9/2013 | Chu | F41A 17/46 124/25 |
| 8,522,767 | B1 * | 9/2013 | Kuhn | F41B 5/1426 124/25 |
| 8,662,061 | B1 * | 3/2014 | Darlington | F41B 5/12 124/25 |
| 8,857,420 | B2 * | 10/2014 | Grace | F41B 5/123 124/25 |
| 8,931,465 | B1 * | 1/2015 | Choma | F41B 5/12 124/25 |
| 8,939,137 | B2 * | 1/2015 | Hunt | F41B 5/143 124/44.5 |
| 8,967,131 | B2 * | 3/2015 | Hunt | F41B 5/143 124/44.5 |
| 9,022,013 | B2 * | 5/2015 | Trpkovski | F41B 5/10 124/25 |
| 2008/0173290 | A1 | 7/2008 | Harwath | |
| 2011/0265774 | A1 | 11/2011 | Watson | |
| 2012/0298087 | A1 * | 11/2012 | Trpkovski | F41B 5/10 124/25 |
| 2013/0098343 | A1 * | 4/2013 | Grace | F41B 5/123 124/25 |
| 2013/0291847 | A1 * | 11/2013 | Darlington | F41B 5/12 124/25 |
| 2014/0083403 | A1 * | 3/2014 | Khoshnood | F41B 5/143 124/44.5 |
| 2014/0174419 | A1 * | 6/2014 | McPherson | F41B 5/12 124/35.1 |
| 2015/0233665 | A1 * | 8/2015 | Trpkovski | F41B 5/12 124/25 |

OTHER PUBLICATIONS

Design U.S. Appl. No. 29/532,942, "Crossbow Stock," Inventor: David A. Barnett, Applicant: Barnett Outdoors, LLC, filed Jul. 13, 2015 (co-pending application).

Design U.S. Appl. No. 29/532,952, "Crossbow Stock," Inventor: David A. Barnett, Applicant: Barnett Outdoors, LLC, filed Jul. 13, 2015 (co-pending application).

Design U.S. Appl. No. 29/532,960, "Crossbow Stock," Inventor: David A. Barnett, Applicant: Barnett Outdoors, LLC, filed Jul. 13, 2015 (co-pending application).

Design U.S. Appl. No. 29/532,968, "Crossbow Stock," Inventor: David A. Barnett, Applicant: Barnett Outdoors, LLC, filed Jul. 13, 2015 (co-pending application).

Design U.S. Appl. No. 29/532,984, "Crossbow Stock," Inventor: David A. Barnett, Applicant: Barnett Outdoors, LLC, filed Jul. 13, 2015 (co-pending application).

U.S. Appl. No. 14/581,828, "Crossbow Arrow Retainer," Inventor: David A. Barnett, Applicant: Barnett Outdoors, LLC, filed Dec. 23, 2014 (co-pending application).

* cited by examiner

CROSSBOW ARROW RETAINER

CROSS-REFERENCE TO RELATED APPLICATIONS

This application claims the benefit of and priority to U.S. patent application Ser. No. 14/581,828, filed on Dec. 23, 2014, now issued as U.S. Pat. No. 9,255,755, which is incorporated by reference herein.

DETAILED DESCRIPTION OF THE PREFERRED EMBODIMENTS

Figure 1:
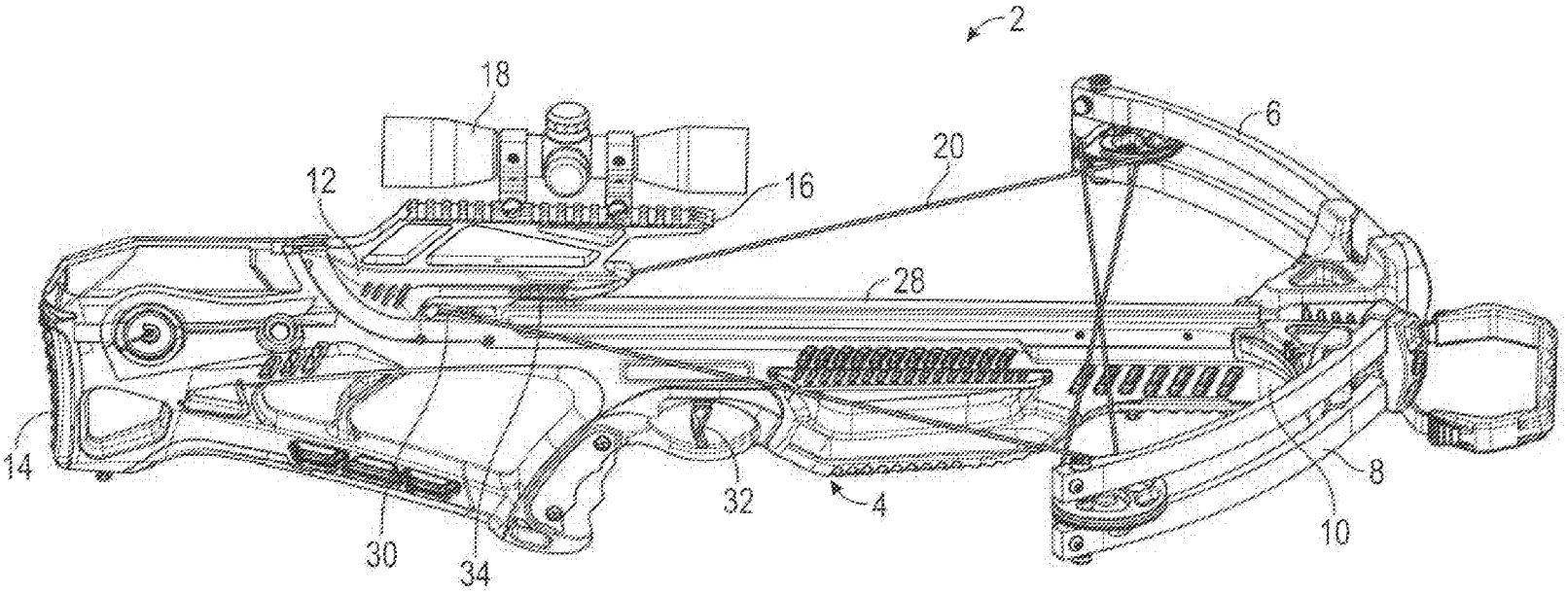
FIG. 1 is a perspective view of a crossbow including an arrow retainer.
Figure 2:
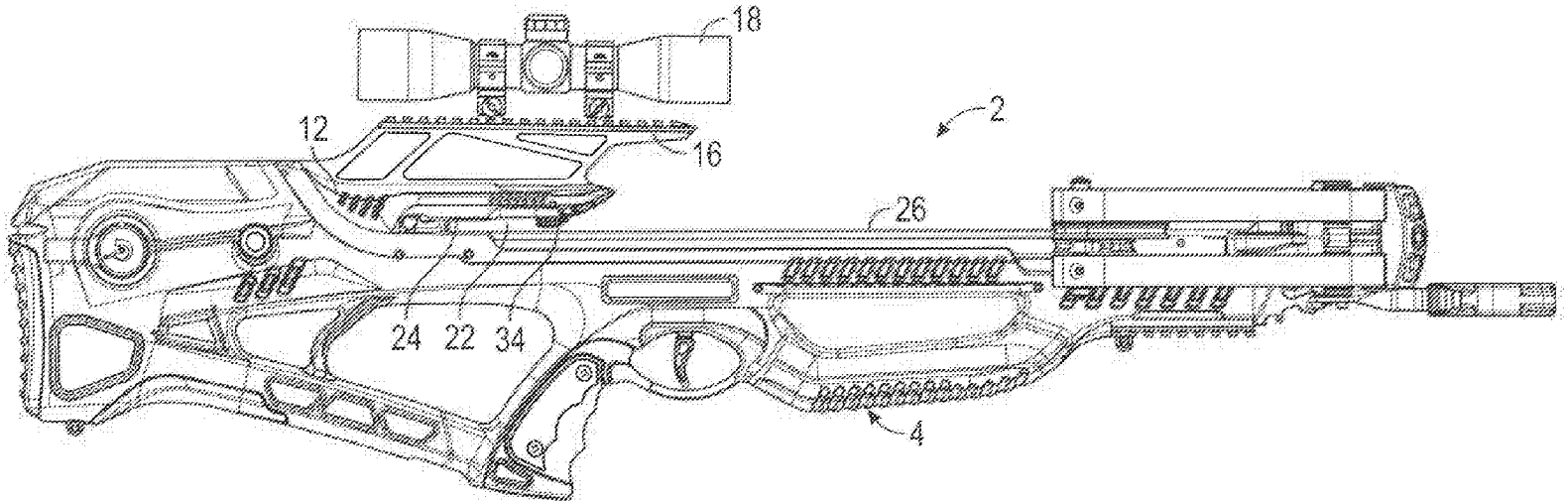
FIG. 2 is a side view of the crossbow with the arrow retainer.

FIGS. 1 and 2 illustrate crossbow 2 including stock 4. Bow limbs 6 and 8 are operatively attached to forward end 10 of stock 4. For example, bow limbs 6 and 8 may be attached to forward end 10 through a riser or through a foot stirrup. Crossbow 2 also includes hood 12 attached to an upper portion of stock 4 between forward end 10 and rearward end 14. Scope rail 16 may be affixed to an upper surface of hood 12 in order to support scope 18. In a cocked position of crossbow 2 (shown in FIG. 1), string 20 engages a trigger catch that secures string 20 in space 22 between lower surface 24 of hood 12 and upper portion 26 of stock 4. With string 20 in this position, arrow 28 may be positioned on upper portion 26 of stock 4 such that nock 30 of arrow 28 is adjacent to string 20 near the trigger catch. Pulling trigger lever 32 may release string 20 from the trigger catch in order to propel arrow 28 forward with string 20.

Arrow retainer 34 may be detachably affixed to hood 12 to assist in retaining arrow 28 on upper portion 26 of stock 4. Arrow retainer 34 may include a plurality of projections extending below lower surface 24 of hood 12 and into space 22. The projections may contact the shaft of arrow 28 to secure arrow 28 in place on upper portion 26 of stock 4 when crossbow 2 is in the cocked position as shown. The projections may impose a predetermined force on the shaft of arrow 28. The predetermined force may be sufficient to retain arrow 28 on stock 4 without slowing the speed of arrow 28 when released from crossbow 2.

Figure 3:
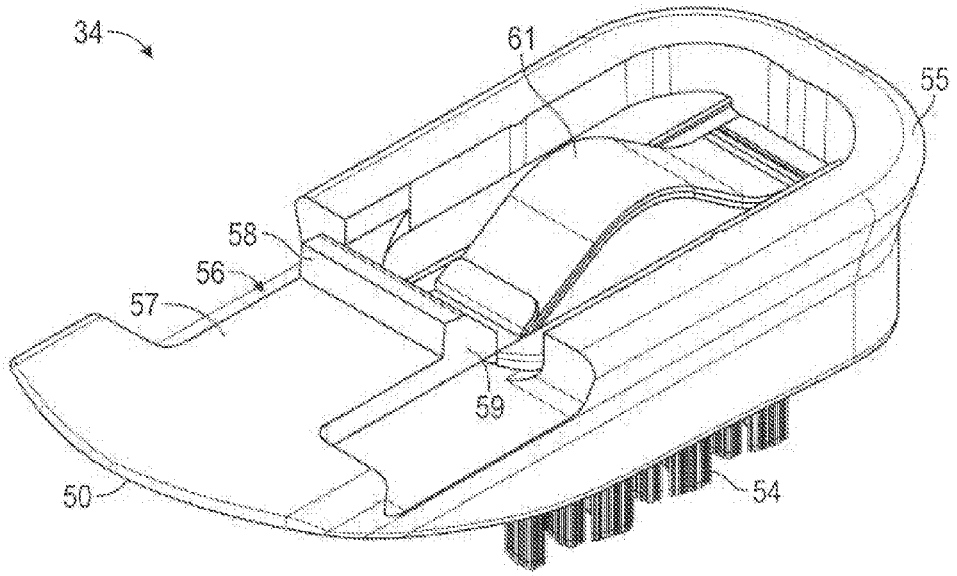
FIG. 3 is a top perspective view of a retainer insert and a housing of the arrow retainer
Figure 4:
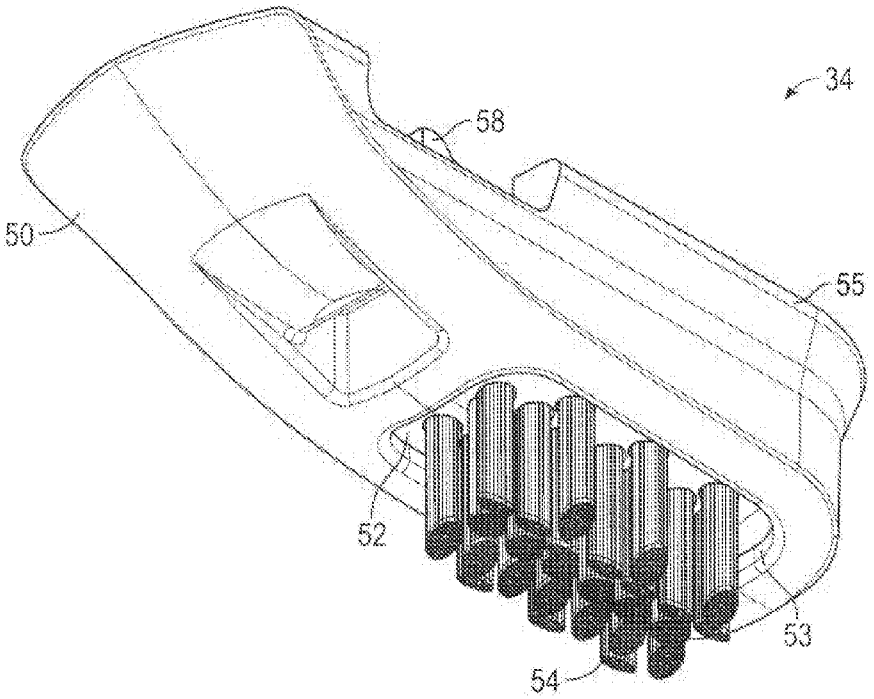
FIG. 4 is a bottom perspective view of a retainer insert and a housing of the arrow retainer.
Figure 5:
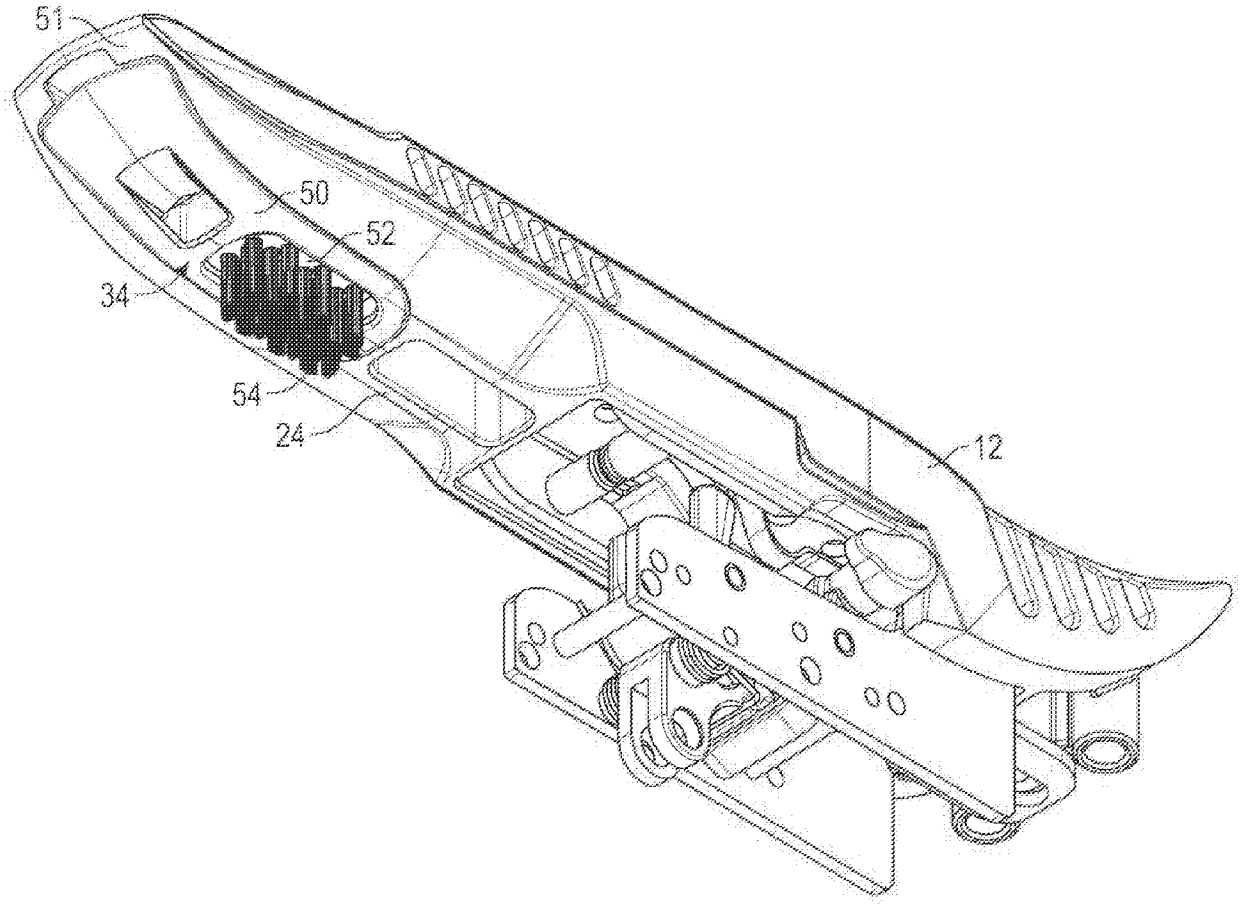
FIG. 5 is a bottom perspective view of the arrow retainer attached to the crossbow hood.

Referring now to FIGS. 3-5, arrow retainer 34 may include housing 50 that is detachably connected to forward end 51 of hood 12. Retainer insert 52 is disposed within recess 53 of housing 50. Projections 54 may be attached to retainer insert 52, and may extend from a lower surface of retainer insert 52. Housing 50 may also include guide protrusion 55 and locking mechanism 56 for connecting and securing housing 50 to hood 12. Guide protrusion 55 may extend around a substantial portion of an upper segment of housing 50. Locking mechanism 56 may include lever 57 and shoulder 58 at distal end 59 of lever 57. Arrow retainer 34 may also include spring 61 disposed above retainer insert 52. Spring 61 may be formed of any member capable of biasing retainer insert 52 downward when arrow retainer 34 is connected to hood 12. Spring 61 may be, but is not limited to, a leaf spring as shown or a coil spring.

Figure 6:
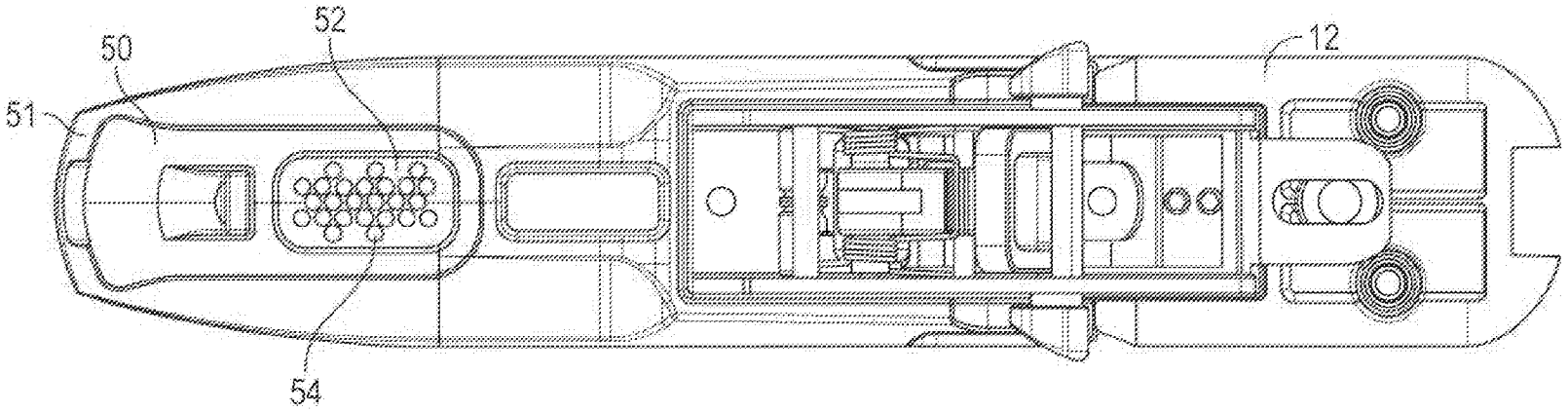
FIG. 6 is a bottom view of the arrow retainer attached to the hood of a crossbow.

Projections 54 may be arranged in any pattern. As shown in FIG. 6, for example, projections 54 may be arranged in five rows. Projections 54 may be formed of bristles or any other elongated members capable of assisting in the retention of arrow 28 on the upper portion of crossbow 2. Retainer insert 52 may be removed from housing 50. For example, retainer insert 52 may be removed from housing 50 and replaced with another retainer insert having a differing arrangement of projections or a differing type of projections. Retainer insert 52 may also be removed from housing 50 in order to replace projections 54 due to wear.

Figure 7:
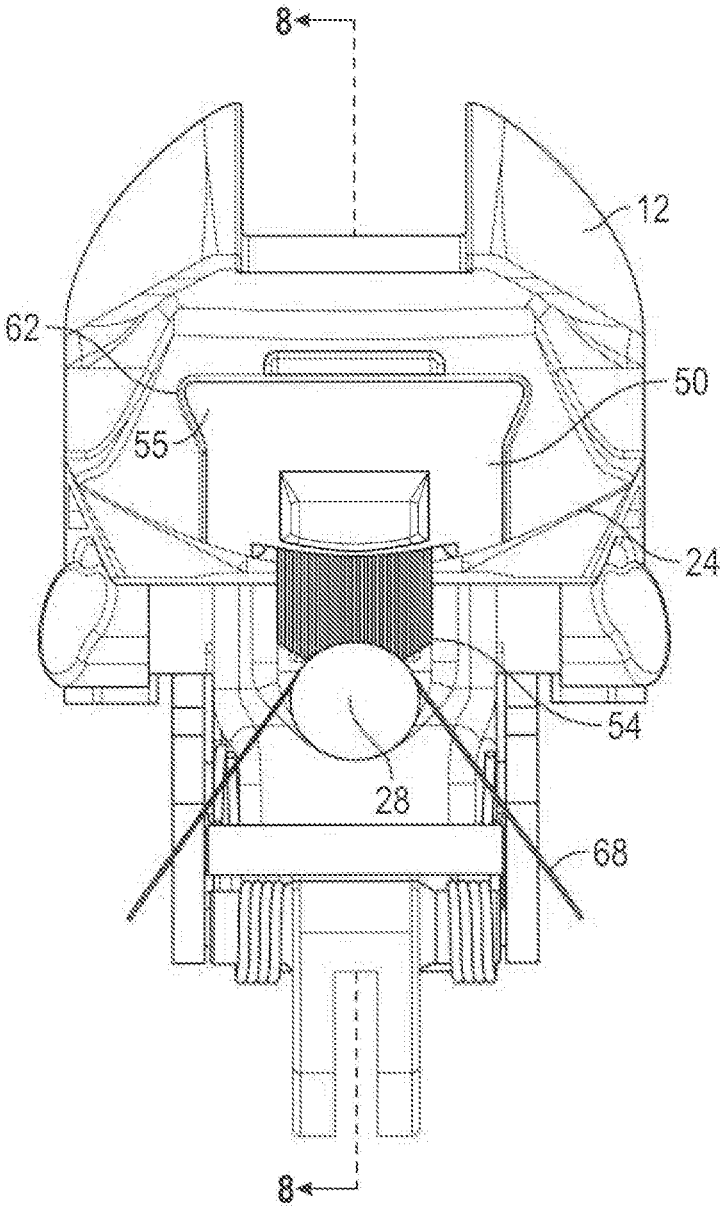
FIG. 7 is a front view of the arrow retainer attached to the hood of a crossbow.
Figure 8:
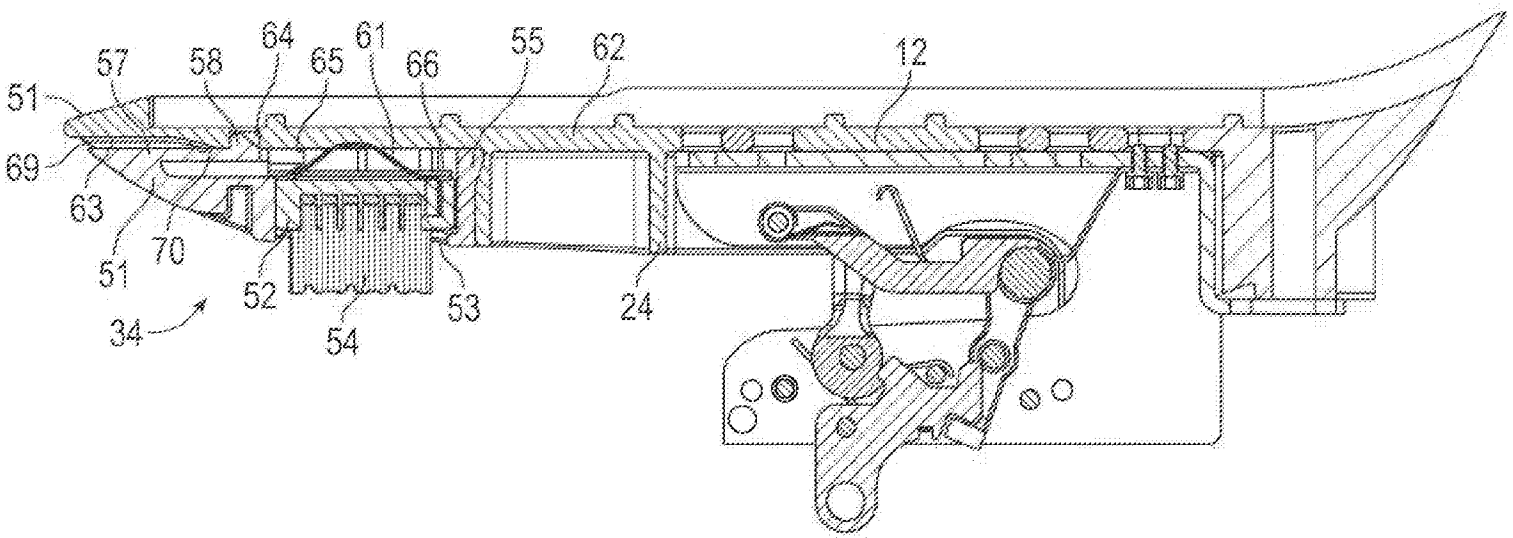
FIG. 8 is a cross-sectional view of the arrow retainer attached to the hood of a crossbow taken along line 8-8 of FIG. 7.

Referring now to FIGS. 7 and 8, housing 50 may slide into hood 12 with guide protrusion 55 of housing 50 sliding into guide recess 62 of hood 12. As housing 50 slides into hood 12, shoulder 58 of locking mechanism 56 may slide along receiving surface 63 of hood 12. When shoulder 58 reaches aperture 64 of hood 12, the interaction between shoulder 58 and aperture 64 may prevent housing 50 from sliding out of hood 12. The interaction of guide protrusion 55 and guide recess 62 may prevent housing 50 from falling from hood 12. In this way, housing 50 may be secured within hood 12. Locking mechanism 56 may be formed of any locking mechanism known to a skilled artisan for detachably securing one object to another, such as a screw, latch, or clip.

With housing 50 disposed within hood 12, spring 61 may engage surface 65 of hood 12 and upper surface 66 of retainer insert 52. Projections 54 may extend below lower surface 24 of hood 12 in order to engage the shaft of arrow 28 (representatively shown in FIG. 7). Spring 61 may bias retainer insert 52 and projections 54 downward toward stock 4 (shown in FIG. 1) in order to apply a predetermined force to the shaft of arrow 28 to retain arrow 28 on an upper portion of stock 4 when crossbow 2 is in a cocked position. In one embodiment, projections 54 may have arched front profile 68 (shown in FIG. 7) such that projections 54 on sides extend beyond projections 54 in center. Arched front profile 68 may match the curvature of an outer surface of the shaft of arrow 28.

Arched front profile 68 may provide more equalized force over the curvature of arrow 28 thereby improving the retention of arrow 28 without slowing the speed of arrow 28 when released from crossbow 2.

With housing 50 secured within hood 12, space 69 may be formed between receiving surface 63 of hood 12 and lever 57 of housing 50. Space 69 may be dimensioned to receive a tool for disengaging shoulder 58 of locking mechanism 56 from aperture 64 of hood 12. For example, an end of the tool may be placed into space 69. The tool may be used to apply a downward force to lever 57 so that shoulder 58 of locking mechanism 56 is lowered. In the lowered position, shoulder 58 is able to slide past end 70 of receiving surface 63 of hood 12 as housing 50 slides out of hood 12. In this way, housing 50 may be detachably connected to hood 12.

Figure 9:
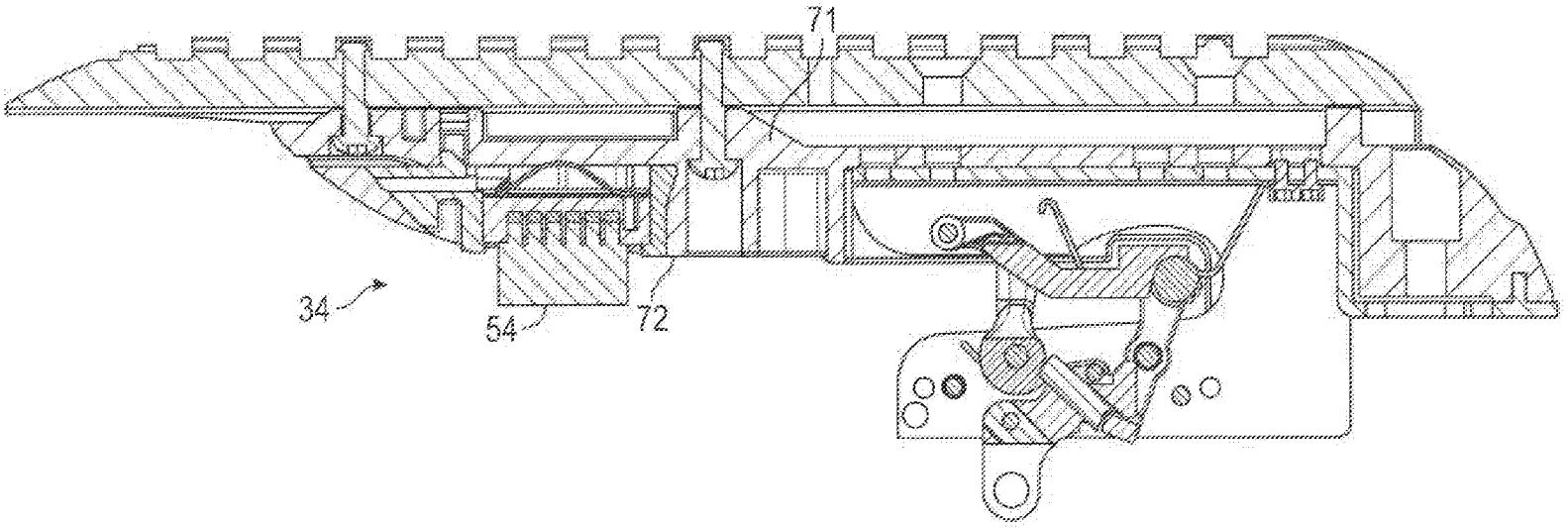
FIG. 9 is an alternate cross-sectional view of FIG. 8 with the arrow retainer attached to an alternate crossbow hood.

Arrow retainer 34 may be used with various crossbows and various hoods. For example, FIG. 9 illustrates arrow retainer 34 secured within hood 71. Projections 54 may extend below lower surface 72 of hood 71 in order to engage the shaft of an arrow.

Figure 10:
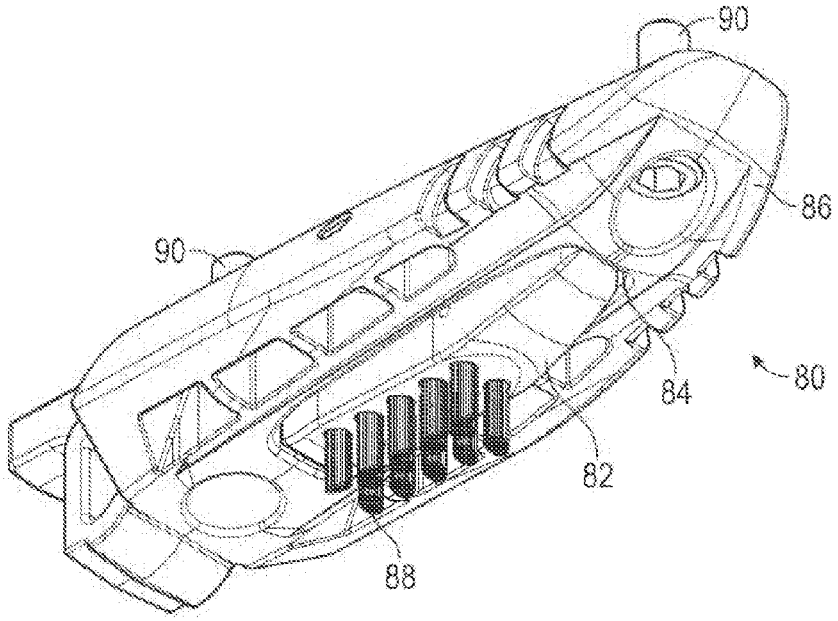
FIG. 10 is a perspective view of an alternate embodiment of the arrow retainer.

FIG. 10 illustrates an alternate embodiment of the arrow retainer. Arrow retainer 80 may include retainer insert 82 disposed within recess 84 of housing 86. Retainer insert may include a plurality of projections 88. Housing 86 may be detachably affixed to a front end of a crossbow hood. In one embodiment, housing 86 may form the front end of the crossbow hood such that a scope rail may attach directly to housing 86, such as with bolts 90. Except as otherwise noted, arrow retainer 80 may include the same features as arrow retainer 34.

Figure 11:
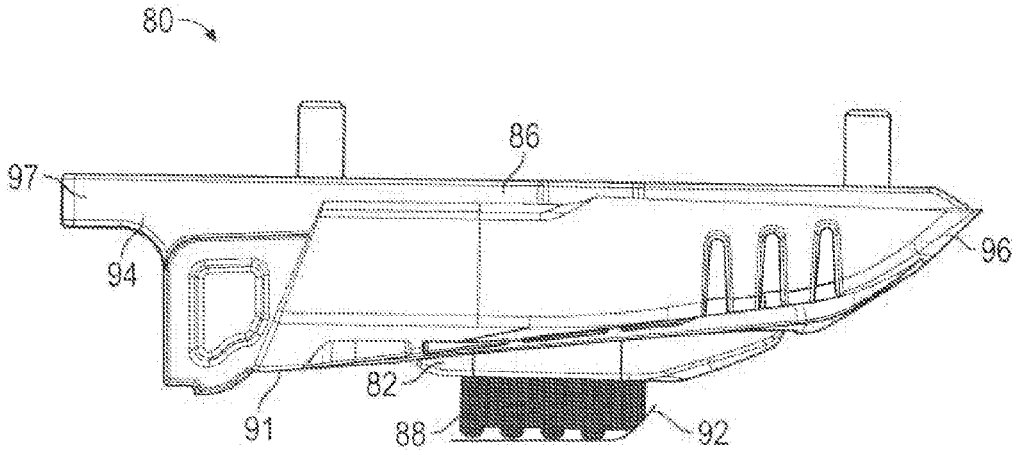
FIG. 11 is a side view of the arrow retainer of FIG. 10.

With reference now to FIG. 11, projections 88 may extend below lower surface 91 of housing 86. Projections 88 may have tapered side profile 92 such that projections 88 closer to rearward end 94 of housing 86 and crossbow 2 extend beyond projections 88 closer to forward end 96 of housing 86 and crossbow 2. Tapered side profile 92 may follow a curvature of forward end 96 of housing 86. This arrangement allows string 20 to be led to the trigger catch with less resistance. Housing 86 may include guide member 97 extending from rearward end 94. Guide member 97 may engage with a recess of a crossbow hood when arrow retainer 80 is connected to the hood.

Figure 12:
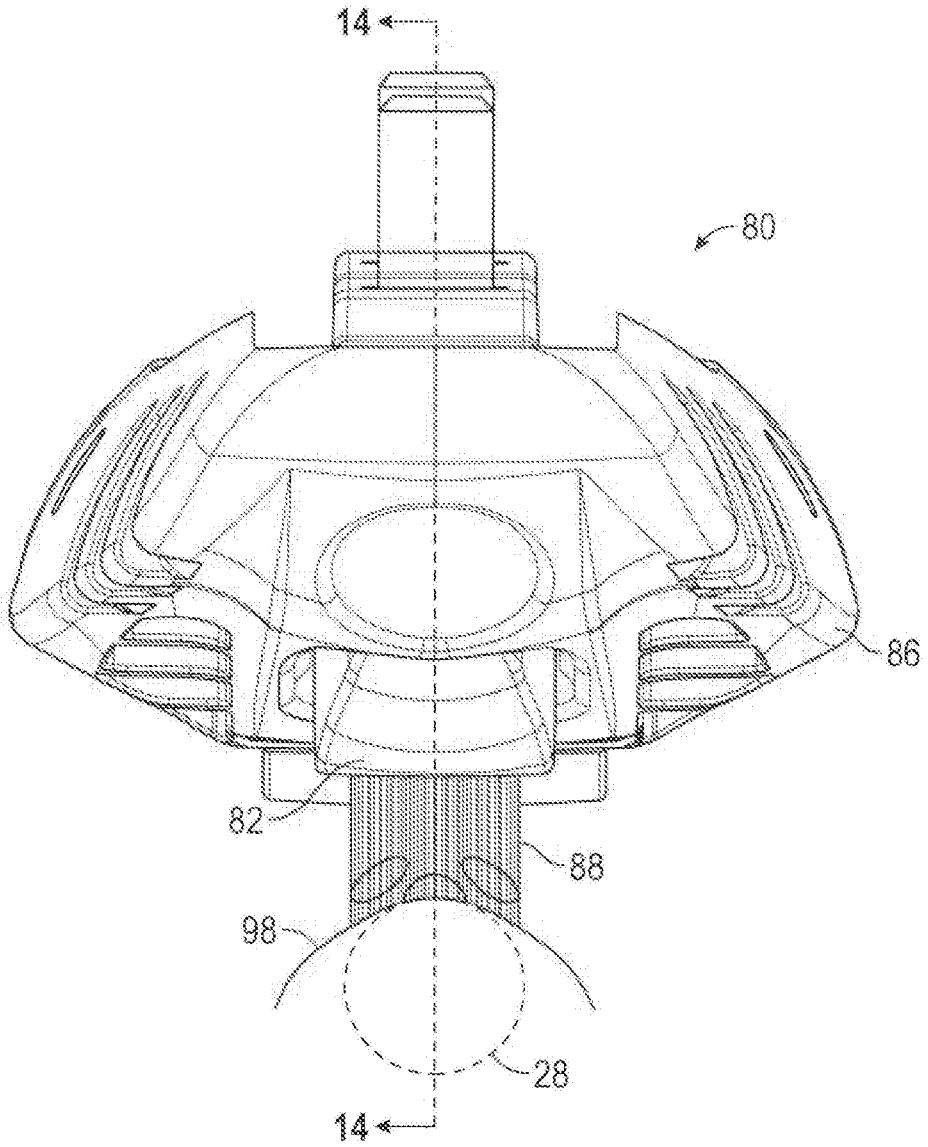
FIG. 12 is a front view of the arrow retainer of FIG. 10.
Figure 13:
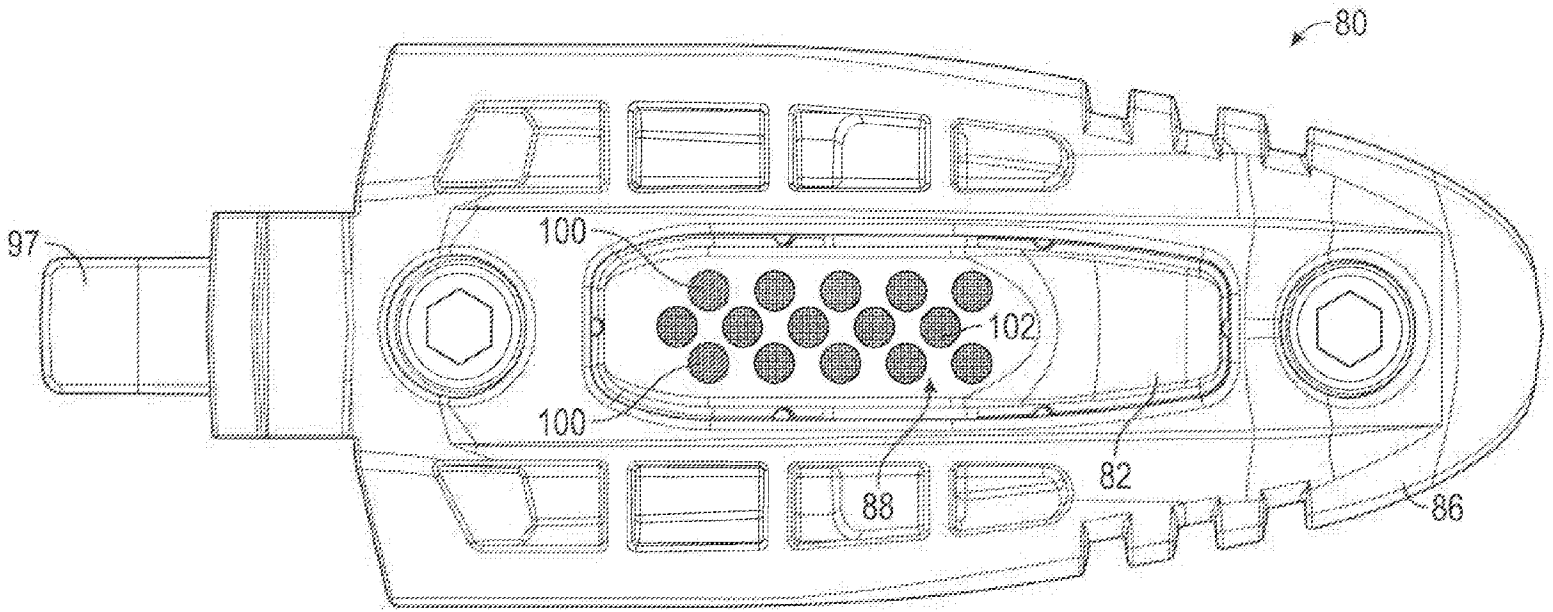
FIG. 13 is a bottom view of the arrow retainer of FIG. 10.

Referring now to FIG. 12, projections 88 may have arched front profile 98 such that projections 88 on sides extend beyond projections 88 in the center. Arched front profile 98 may match the curvature of an outer surface of the shaft of arrow 28. Arched front profile 98 of projections 88 may provide more equalized force over the curvature of the shaft thereby improving the retention of arrow 28 without slowing the speed of arrow 28 when released from crossbow 2. Projections 88 may be arranged in any pattern. For example, as shown in FIG. 13, projections 88 may be arranged in three rows. In one embodiment, projections 88 of the pattern may have varying stiffness values. For example, projections 100 on the side rows of the pattern may have higher stiffness values than projections 102 in the center row of the pattern. This arrangement may further assist in retaining arrow 28 without slowing its speed when released from crossbow 2. Projections 88 may be formed of bristles or any other elongated members capable of assisting in the retention of arrow 28 on the upper portion of crossbow 2. Retainer insert 82 may be removed from housing 86. For example, retainer insert 82 may be removed from housing 86 and replaced with another retainer insert having a differing pattern of projections or a differing type of projections. Retainer insert 82 may also be removed from housing 86 in order to replace projections 88 due to wear.

Figure 14:
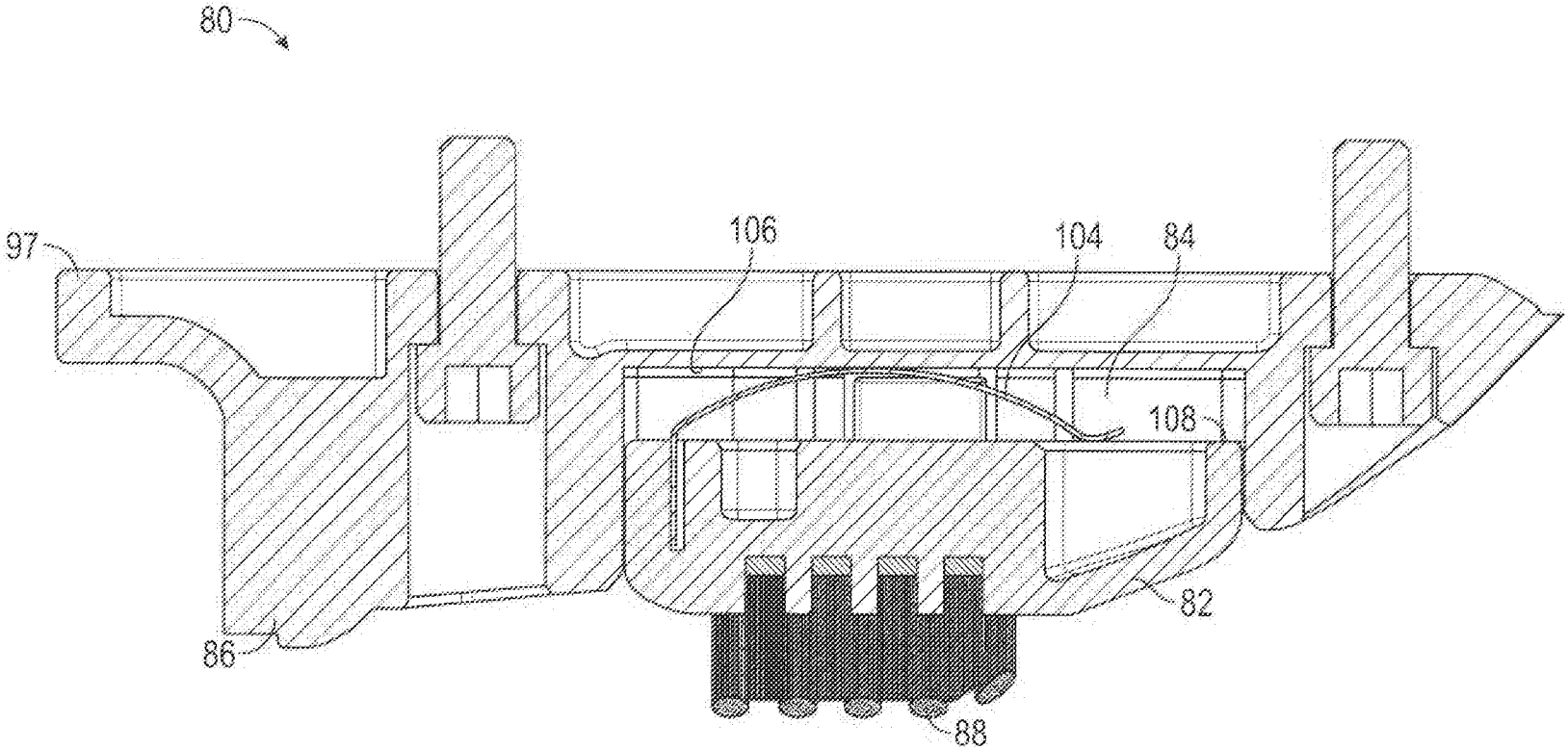
FIG. 14 is a cross-sectional view of the arrow retainer of FIG. 10 taken along line 14-14 in FIG. 12.

With reference to FIG. 14, arrow retainer 80 may include spring 104 disposed above retainer insert 82 in recess 84 of hood 86. Spring 104 may engage upper surface 106 of recess 84 and upper surface 108 of retainer insert 82. Spring 104 may bias retainer insert 82 and projections 88 downward toward stock 4 (shown in FIG. 1) in order to apply a predetermined force to the shaft of arrow 28 on an upper portion of stock 4 when crossbow 2 is in a cocked position. Spring 104 may be formed of any member capable of biasing retainer insert 82 downward when retainer insert 82 is disposed within recess 84 of housing 86. Spring 104 may be, but is not limited to, a leaf spring as shown or a coil spring.

In another alternate embodiment, the retainer insert may be disposed within a recess of a hood of a crossbow such that the projections extend below a lower surface of the hood. In yet another alternate embodiment, the arrow retainer may be detachably connected to a hood of a crossbow with no spring biasing the arrow retainer. In a further alternate embodiment, the projections may be affixed to a lower surface of the hood directly.

Figure 15:
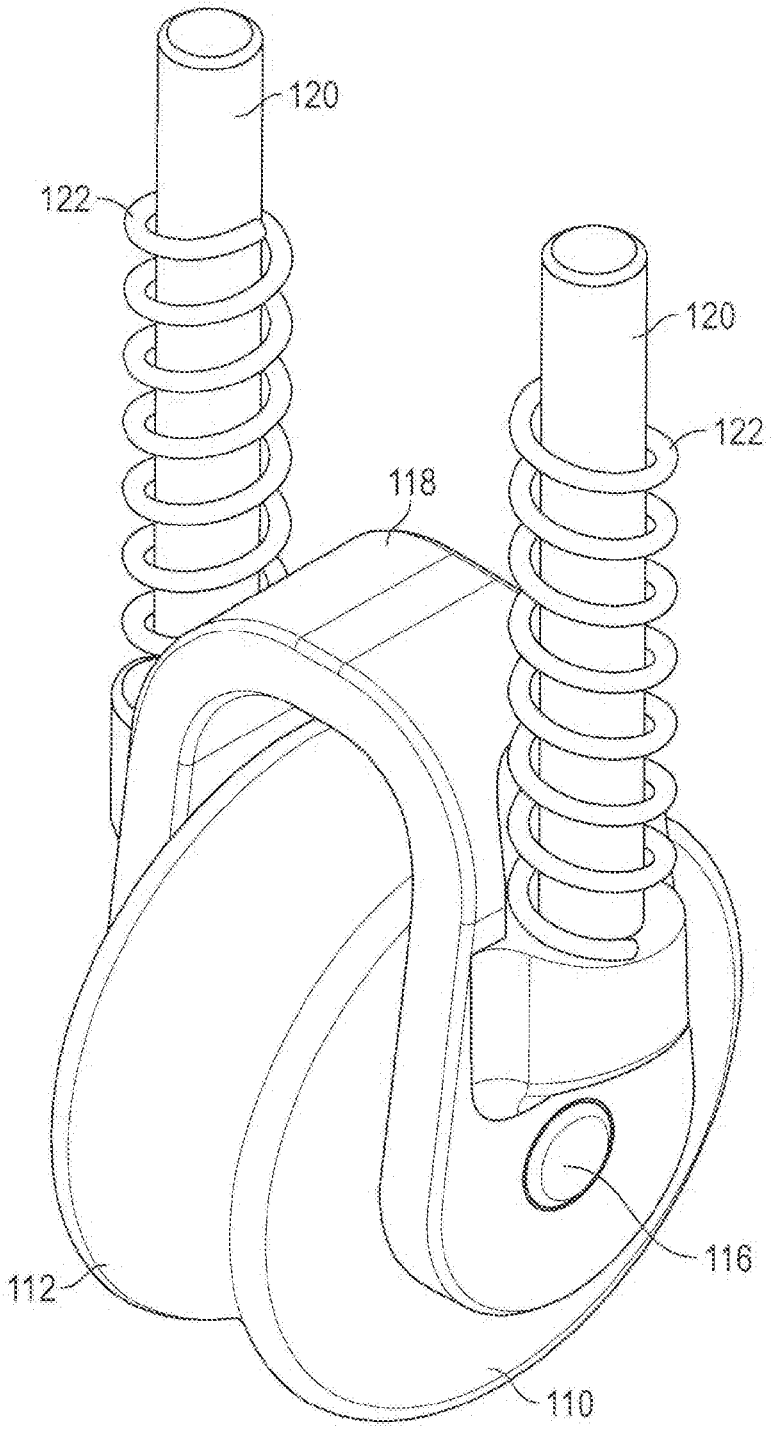
FIG. 15 is a perspective view of a retainer insert wheel of an alternate arrow retainer.
Figure 16:
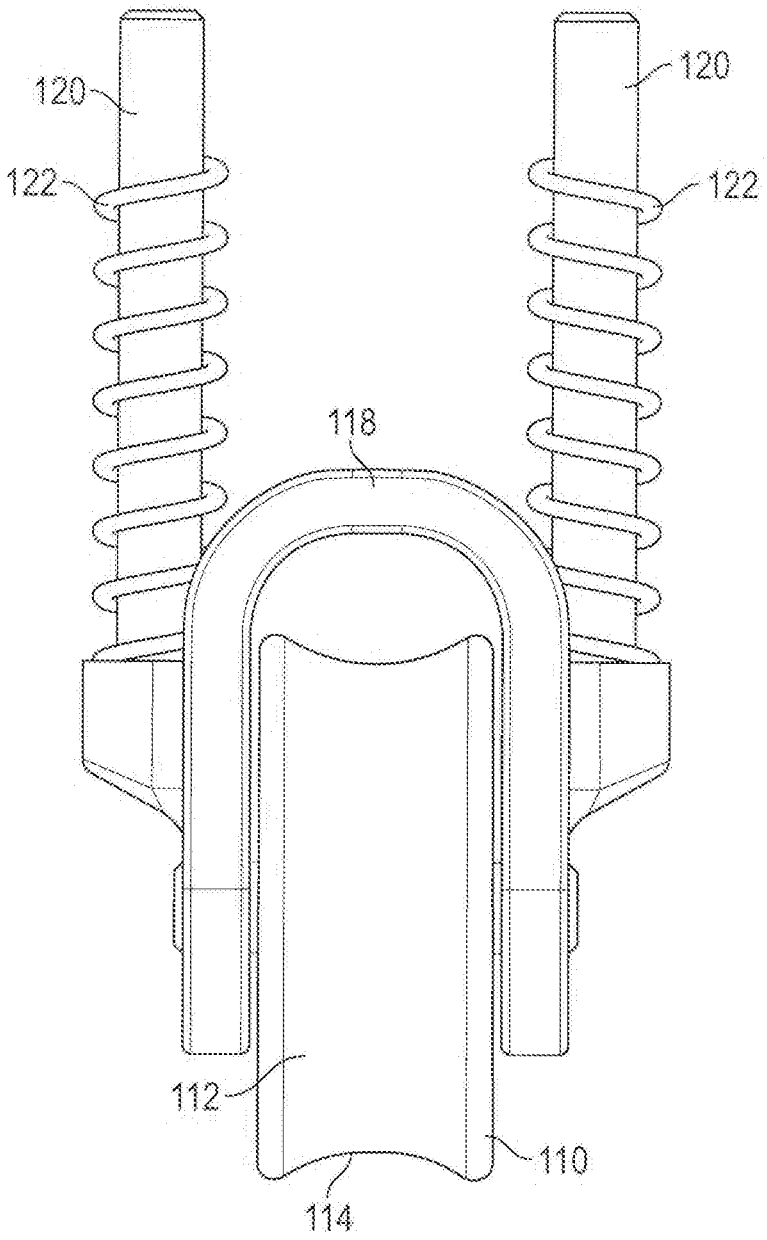
FIG. 16 is a front view of the retainer insert wheel.

One alternate embodiment of the arrow retainer includes a retainer insert wheel having a circumferential surface with a concave profile dimensioned for accommodating an arrow. For example, FIGS. 15 and 16 illustrate retainer insert wheel 110 having circumferential surface 112 with concave profile 114. Retainer insert wheel 110 may rotate about axle 116, which may be connected to frame 118. Vertical posts 120 may extend from each side of frame 118. Spring 122 may be disposed around each vertical post 120.

Figure 17:
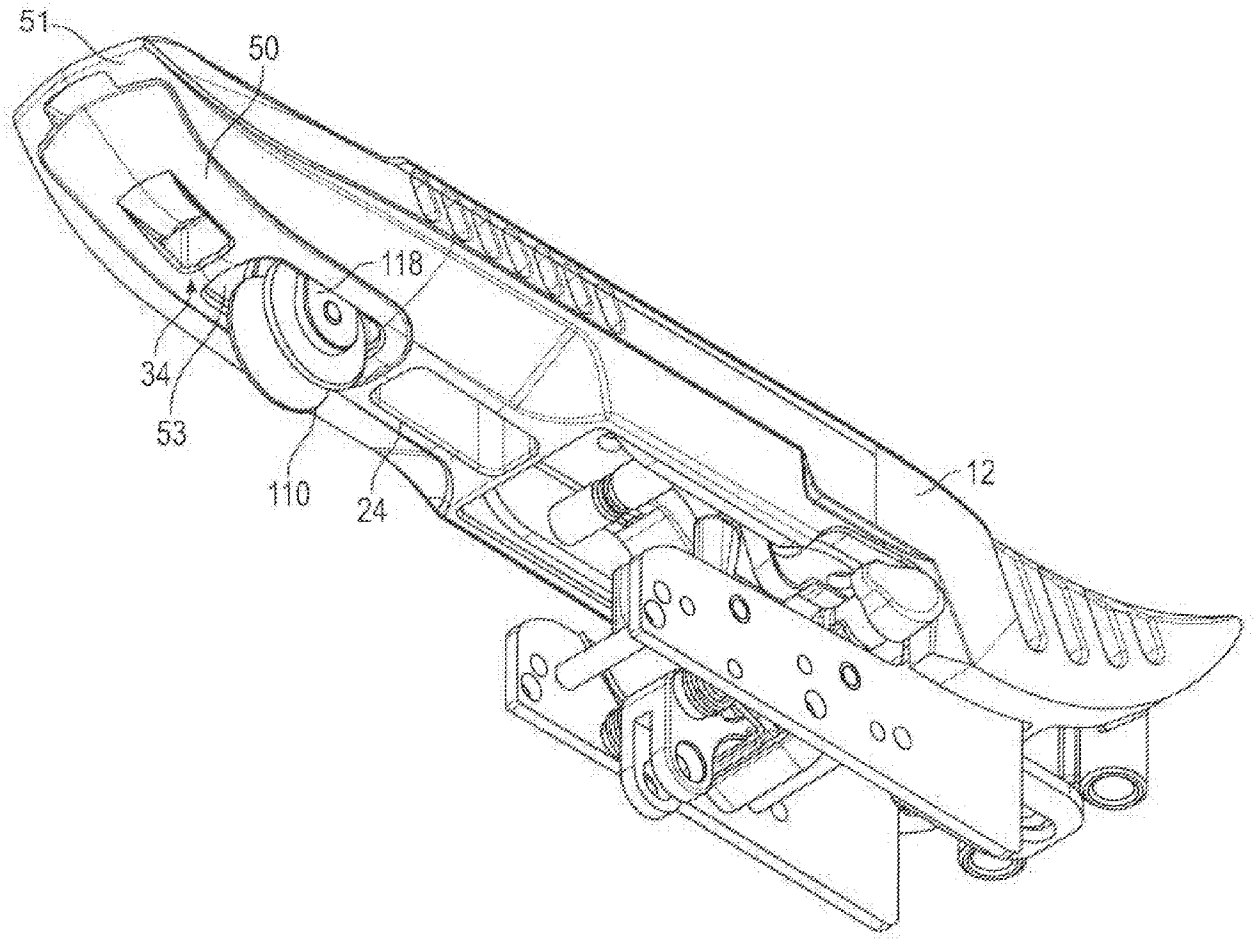
FIG. 17 is a bottom perspective view of the arrow retainer including the retainer insert wheel connected to a crossbow hood.
Figure 18:
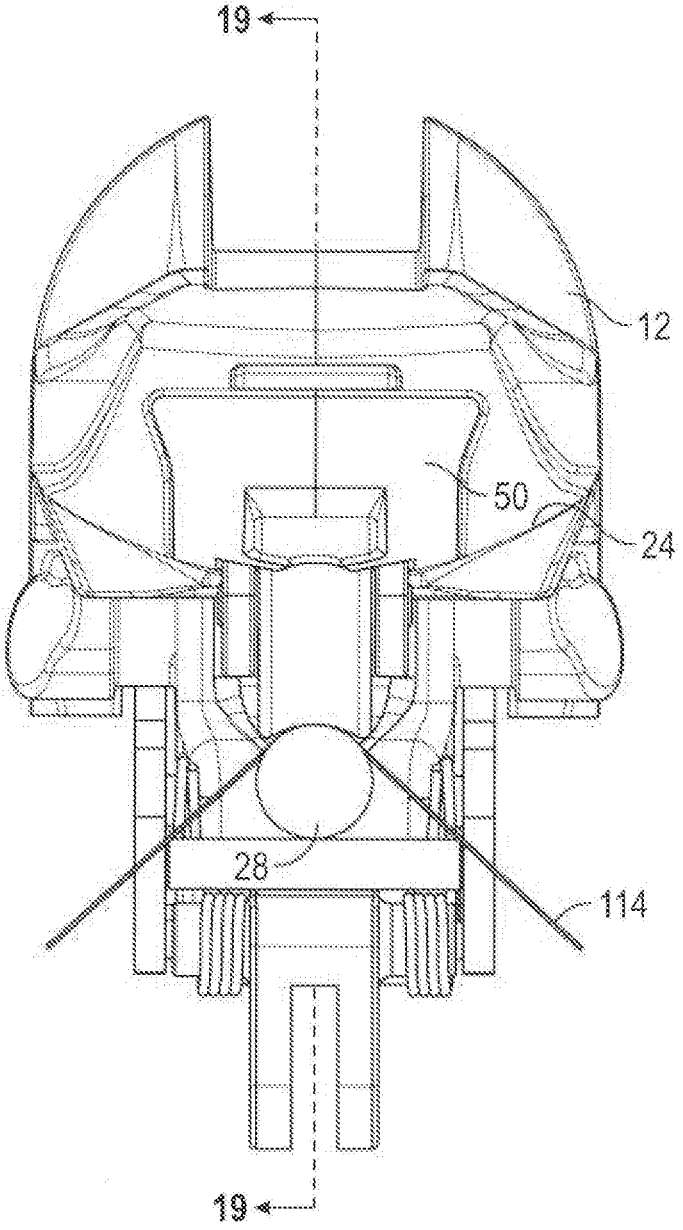
FIG. 18 is a front view of the arrow retainer including the retainer insert wheel connected to a crossbow hood.
Figure 19:
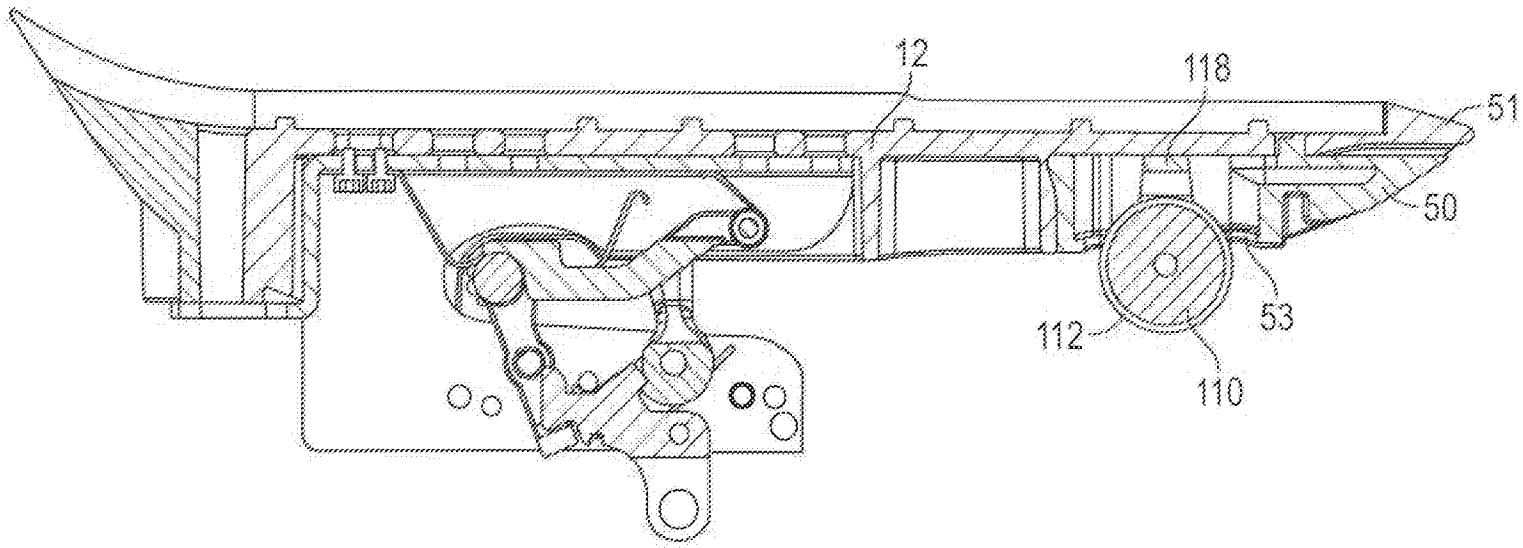
FIG. 19 is a cross-sectional view of the arrow retainer including the retainer insert wheel connected to a crossbow hood taken along line 19-19 of FIG. 18.

With reference to FIGS. 17-19, retainer insert wheel 110 may be secured within recess 53 of housing 50, which may be detachably connected to forward end 51 of hood 12. Circumferential surface 112 of retainer insert wheel 110 may extend below lower surface 24 of hood 12. Retainer insert wheel 110 may be configured to rotate in a rearward direction as arrow 28 is placed on an upper surface of the crossbow stock, and to rotate in a forward direction as arrow 28 is released from the crossbow. Springs 122 may bias retainer insert wheel 110 downward toward the crossbow stock, but may allow retainer insert wheel 110 to be vertically displaced. Concave profile 114 of circumferential surface 112 of retainer insert wheel 110 may assist in retaining arrow on the upper portion of the crossbow stock. In this way, retainer insert wheel 110 may be configured for forward and rearward rotation, and for upward and downward movement, to ease the interaction between retainer insert wheel 110 and 28 arrow for retaining arrow 28 on the upper portion of the crossbow stock. Alternatively, retainer insert wheel 110 may be secured directly within a recess of a crossbow hood.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. An arrow retainer for a crossbow, comprising:

a housing having an upper section, a lower section, a forward end section, and a rearward end section, the upper section being configured to detachably connect to a scope rail, the rearward end section being configured to detachably connect to a forward end section of a crossbow hood, the lower section including a recess; and a retainer insert having an upper surface and a lower surface, the retainer insert being detachably disposed within the recess of the lower section of the housing, the retainer insert including a plurality of projections extending below the lower surface of the retainer insert for retaining an arrow on a stock of the crossbow when the housing is connected to the forward end section of the crossbow hood.

2. The arrow retainer of claim 1, further comprising a spring disposed within the recess of the housing, the spring biasing the retainer insert.

3. The arrow retainer of claim 2, wherein the spring is a leaf spring or a coil spring.

4. The arrow retainer of claim 1, wherein the upper surface of the retainer insert includes a locking mechanism, the locking mechanism securing the retainer insert to the housing.

5. The arrow retainer of claim 4, wherein the locking mechanism includes a lever having a shoulder at a distal end of the lever.

6. The arrow retainer of claim 1, wherein the plurality of projections is formed of bristles.

7. The arrow retainer of claim 6, wherein the bristles vary in stiffness.

8. The arrow retainer of claim 1, wherein the plurality of projections includes a tapered side profile such that the projections closer to the rearward end of the housing extend further from the hood than the projections closer to the forward end of the housing.

9. The arrow retainer of claim 1, wherein the plurality of projections includes an arched forward profile or a flat forward profile.

10. The arrow retainer of claim 1, wherein the housing includes one or more bolt recesses, each bolt recess accommodating a bolt for detachably connecting the upper section of the housing to the scope rail.

11. The arrow retainer of claim 1, wherein the rearward end section of the housing includes a guide member that operatively engages with a recess in the forward end of the crossbow hood when the rearward end section of the housing is detachable connected to the forward end of the crossbow hood.

12. An arrow retainer for a crossbow, comprising:

a housing having an upper section configured to detachably connect to a receiving surface on an underside of a forward end of a longitudinal member of the crossbow, the longitudinal member being configured to be vertically spaced above an upper portion of a crossbow stock, the housing including a recess; and a retainer insert having an upper surface and a lower surface, the retainer insert being detachably disposed within the recess of the housing, the retainer insert including a wheel assembly extending below the lower surface of the retainer insert for retaining an arrow on the upper portion of the crossbow stock when the housing is connected to the longitudinal member of the crossbow.

13. The arrow retainer of claim 12, wherein the wheel assembly includes a wheel member having a circumferential surface extending below the lower surface of the retainer insert, the circumferential surface including a concave profile, and the wheel member being configured for rotation in two directions.

14. The arrow retainer of claim 13, wherein the wheel assembly includes a frame and an axle disposed through the wheel member, the frame being operatively connected to the axle and to the retainer insert, the wheel member being configured to rotate in a forward direction and in a rearward direction around the axle.

15. The arrow retainer of claim 14, wherein the frame is U-shaped and includes opposite sides, the wheel assembly includes two vertical posts having an upper end and a lower end, each vertical post includes a spring operatively positioned thereon, the lower end of each vertical post is operatively affixed to one of the opposite sides of the U-shaped frame.

16. An arrow retaining assembly for a crossbow comprising an arrow retainer having an upper surface and a lower surface, the upper surface of the arrow retainer being configured to detachably connect to a receiving surface on an underside of a forward end of a longitudinal member of the crossbow, the longitudinal member being configured to be vertically spaced above an upper portion of a crossbow stock, the arrow retainer including a plurality of projections extending below the lower surface of the arrow retainer for retaining an arrow on the upper portion of the crossbow stock when the arrow retainer is connected to the longitudinal member of the crossbow.

17. The arrow retaining assembly of claim 16, wherein the plurality of projections imposes a predetermined force on a shaft of the arrow sufficient to retain the arrow on the upper portion of the crossbow stock.

18. The arrow retaining assembly of claim 17, wherein the predetermined force does not slow a speed of the arrow when the arrow is released from the crossbow.

19. The arrow retaining assembly of claim 16, wherein the projections of the plurality of projections are arranged in rows.

20. The arrow retaining assembly of claim 19, wherein the projections of the plurality of projections are arranged in five rows.

21. The arrow retaining assembly of claim 16, wherein the projections of the plurality of projections are each formed of bristles.

22. The arrow retaining assembly of claim 21, wherein the bristles vary in stiffness.

23. The arrow retaining assembly of claim 16, wherein the plurality of projections includes a tapered side profile such that the projections closer to a rearward end of the arrow retainer extend further from the longitudinal member than the projections closer to a forward end of the arrow retainer.

24. The arrow retaining assembly of claim 16, wherein the plurality of projections includes an arched forward profile or a flat forward profile.

* * * * *